United States Patent [19]

Yasuda

[11] Patent Number: 4,728,846

[45] Date of Patent: Mar. 1, 1988

[54] ELECTRON GUN IN WHICH THE LARGE DIAMETER PORTION OF THE FIRST ANODE IS RIGIDLY SUPPORTED

[75] Inventor: Hidekatsu Yasuda, Kanagawa, Japan

[73] Assignee: Sony Corporation, Tokyo, Japan

[21] Appl. No.: 867,535

[22] Filed: May 28, 1986

[30] Foreign Application Priority Data

May 28, 1985 [JP] Japan ..... 60-114694

[51] Int. Cl.[4] ..... H01J 29/82

[52] U.S. Cl. ..... 313/451; 313/457

[58] Field of Search ..... 313/451, 457, 417, 449, 313/458, 460, 456, 438

[56] References Cited

U.S. PATENT DOCUMENTS 2,991,390 7/1961 Shrader ..... 313/451 X 3,142,775 7/1964 Shaw ..... 313/451

4,271,374 6/1981 Kimura ..... 313/449

*Primary Examiner*—David K. Moore

*Assistant Examiner*—K. Wieder

*Attorney, Agent, or Firm*—Hill, Van Santen, Steadman & Simpson

[57] ABSTRACT

A bipotential electron gun for cathode ray tubes comprising an arrangement of a cathode, a control electrode, and an accelerating electrode, a first anode and a second anode such that the second anode is formed with windows in its large diameter cylindrical portion and the large diameter end portion of the first anode is mounted within the large diameter cylindrical portion and is fixedly supported by an insulating support member that extends through the windows such that the first anode is firmly supported and coaxially mounted between the first anode and the second anode which form the principal lens in a secure manner.

2 Claims, 4 Drawing Figures

ELECTRON GUN IN WHICH THE LARGE DIAMETER PORTION OF THE FIRST ANODE IS RIGIDLY SUPPORTED

CROSS-REFERENCES TO RELATED APPLICATIONS

This application is related to application Ser. No. 469,290, filed Feb. 24, 1983 entitled "ELECTRON GUN" in which the inventors are Masahiro Kikuchi, Yuzuru Kobori and Kanemitsu Murakami and which is assigned to Sony Corporation.

BACKGROUND OF THE INVENTION

1. Field of the Invention

This invention relates in general to electron guns for cathode ray tubes and particularly to an improved electron gun for high resolution color cathode ray tubes and also to beamindex color cathode ray tubes.

2. Description of the Prior Art

High resolution color cathode ray tubes require an electron gun which has an excellent beam focusing characteristic. Thus, previously there have been proposed various types of electron guns having large-aperture anodes so as to reduce the spherical aberration of the electron lens, particularly of the principal lens. There is known, for example, a large aperture electron gun in which a conductive coating is applied to the inside of the bulb neck portion of the envelope which serves as the second anode but such type tube is not reliable because the neck of the tube is not round and, thus, there will be eccentricity between the first and second anodes of this type of tube.

There has also been proposed an electron gun having a large aperture anode such as illustrated in FIG. 3. In FIG. 3, the electron gun has a cathode K which is supported by common insulating support members 3. Also, mounted in the electron gun is a control electrode G1 of generally cylindrical-shape with an opening in its end face and an accelerating electrode G2 of generally cylindrical shape with an opening in its end face. A first anode G3 is formed of a generally cylindrical-shaped portion 5 of smaller diameter than its second portion 2 which has a larger diameter. The electrodes G1 and G2 and the first anode G3 are supported from the supporting members 3 and the first anode G3 is supported from the support members 3 in the small diameter portion 5 as illustrated. A second anode G4 has a large diameter cylindrical portion 1 which extends around the portion 2 of the first anode and also extends beyond the end of the enlarged portion 2. The second anode G4 also has a smaller diameter portion 17 which is concentric with the smaller diameter portion 5 of the first anode G3 and the second anode G4 is supported from the insulating support members 3 which have supports that extend to the small diameter portion 17 of the second anode.

The electron gun illustrated in FIG. 3 has a first anode G3 in which the cross-sectional dimension remains close to a perfect circle. However, since the first anode G3 is supported at its small diameter portion 5 from the support members 3 and also since the point of support of the small diameter 5 is a relatively great distance from the principal lens forming portion which is between the portions 2 and 1 and also since the first anode G3 is rather long and the large diameter portion 2 which forms a part of the principal lens is rather heavy, mechanical instability exists and it is very difficult to obtain and maintain symmetry between the large portion 2 of the first anode G3 and the large portion 1 of the second anode G4.

SUMMARY OF THE INVENTION

So as to solve the problems of the prior art, the present invention has a primary object to provide in an electron gun having a large aperture anode used therein and an electron gun for cathode ray tubes which assures that the large cylindrical portions of the first and second anodes are maintained concentric and symmetrical so as to provide an improved principal lens and such that they are coaxial thus rendering the gun very accurate and reliable.

So as to achieve these objects in the present invention, an electron gun which has a cathode K, a control electrode G1, an accelerating electrode G2, a first anode G3 and a second anode G4 coaxially arranged in succession and with the principal lens formed between the first anode G3 and the second anode G4. It is arranged such that the second anode G4 has a small diameter supported end portion 6 and a large diameter cylindrical portion 1 which is connected thereto. The large diameter cylindrical portion 1 is formed with a number of windows as well as the end wall portion 18 which joins the small diameter portion 6 and the large diameter portion 1 and the longitudinal insulated supported members 12 have portions 15 which extend into such windows 11 and from which extend support members 16 from the insulating ends 15 of the members 12 to support the large diameter portion 2 of the first anode G3. The first anode G3 passes through the smaller diameter end portion 6 of the second anode G4 without making contact therewith and the larger diameter end portion 2 of the first anode G3 is mounted within the large diameter cylindrical portion 1 of the second anode G4 and within the window portions 11 such that the ends 15 of the supporting insulating members 12 can be connected by insulating support members 16 to the large diameter portion 2 of the first anode G3.

The form of the large diameter end portions 2 of the first anode G3 is not limited to the cylindrical form described above, but it may be of any shape or form such, for example, that its diameter gradually increases as it extends to its front end and may be of a so-called trumpet shape. Although the first anode G3 is illustrated as being supported at its large diameter end portion through the windows 11, it is to be realized that it may also be supported through windows in the portion 6 which extend through the small diameter portion 5 of the first anode G3.

According to the present invention, there is formed a large aperture first anode G3 and a second anode G4 of cylindrical shape and, thus, the spherical aberration of the main lens is decreased over structures of the prior art. Since the relatively long first anode G3 is supported at its large diameter end portion 2 which forms part of the principal lens and is supported through the window portion 11 of the second anode G4, the mechanical support for the first anode G3 is very strong and no eccentricity will exist between the first anode G3 and the second anode G4 and they will be held so that they are coaxial. Under vibration conditions, the first anode G3 will be firmly fixed relative to the second anode G4 due to the support of the invention. In addition, by supporting the first anode G3 at its small diameter portion 5 through the window portions 11 the alignment of the principal lens is ensured and also the diameter of the principal lens can be made to be larger.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
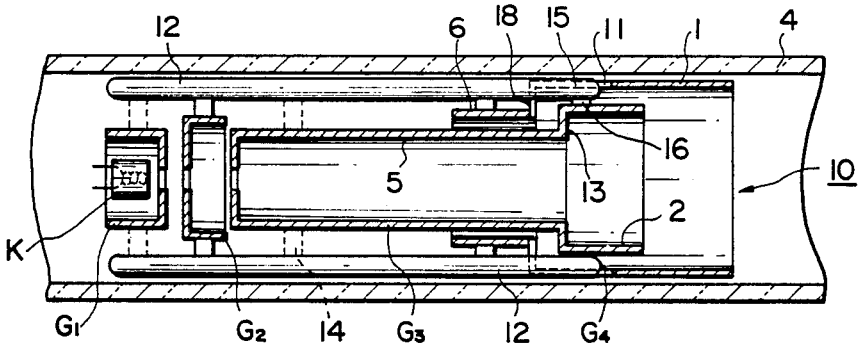
FIG. 1 is a cross-section view showing a preferred embodiment of an electron gun for a cathode ray tube according to the present invention.
Figure 2:
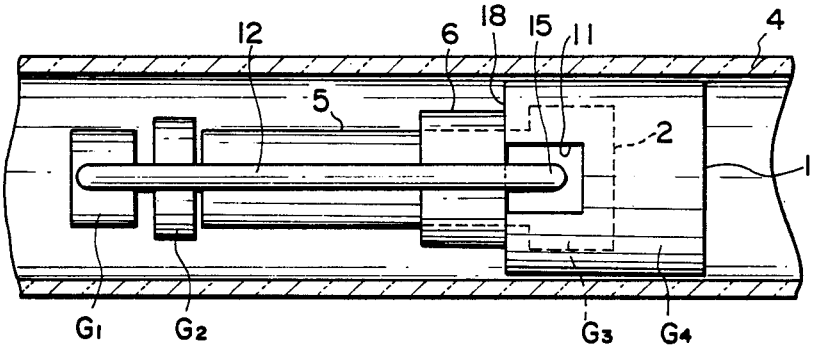
FIG. 2 is a plan view of the invention.
Figure 3:
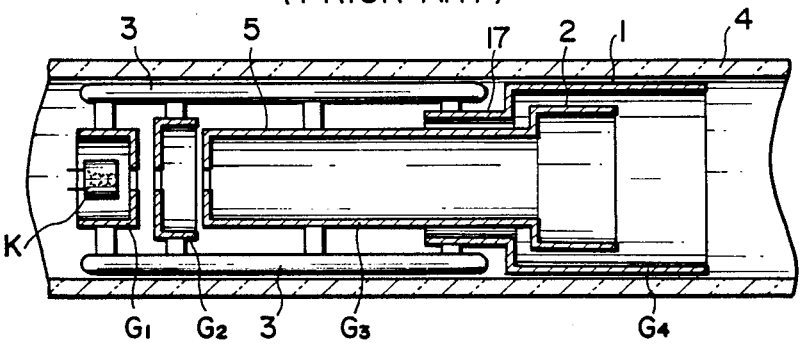
FIG. 3 (PRIOR ART)
FIG. 3 is a cross-sectional view illustrating an electron gun of the prior art.

A preferred embodiment of the electron gun for cathode ray tubes according to the present invention is illustrated in FIGS. 1 and 2. A bulb neck portion 4 has mounted therein a bipotential electron gun 10 formed according to the invention.

The electron gun 10 consists of a plurality of extending insulating support members 12 from which are mounted a control electrode G1 and then an accelerating electrode G2 and a first anode G3 and a second anode G4. The second anode G4 has a large diameter cylindrical portion 1 which is spaced closely to the bulb neck portion 4 and has a small diameter portion 6 which is connected to the large diameter portion 6 which is connected to the large diameter portion with an end wall 18. The small diameter portion 6 is supported from the longitudinal insulating members 12. A pair of windows 11 are formed in the large diameter cylindrical portion 1 of the second anode G1 and the ends 15 of the longitudinal insulating supporting members 12 extend over said windows and support members 16 extend from the ends 15 to engage and support the first anode G3 by connecting to the large diameter portion 2 of the first anode portion G3.

The first anode G3 is formed with a small diameter portion 5 which extends into the small diameter portion 6 and into the large diameter portion 1 of the second anode G4. In the embodiment illustrated in FIG. 1, the large end portion 2 covers the windows 11 and the first anode G3 is supported from the supports 15 and extensions 16 which extend through the windows 11 to engage the large diameter portion 2. The large diameter portion 2 and the large diameter portion 1 form the principal lens. The electrodes G1 through G4 are fixedly supported by the pair of common insulating supporting members 12 and the second anode G4 is supported from its small diameter portion 6 and the first anode G3 is supported from its large diameter end portion 2 which is mounted in the windows 11 and is supported from the ends 15 of the insulating support members 12 by the extension 16.

In the described structure, the large diameter end portion 2 of the first anode G3 is supported in an insulated manner through the windows 11 formed in the large diameter cylindrical portion 1 of the second anode G4 and therefore the mechanical support of the first anode G3 is secure and also the problems of eccentricity between the first anode G3 and the second anode G4 in the principal lens is solved in that these members can be maintained concentric with each other and are very accurately positioned.

Figure 1A:
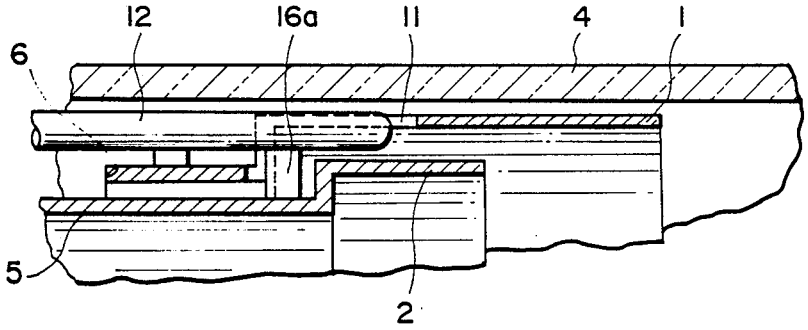
FIG. 1*a* illustrates a modification of the invention.

Although in the above example, the first anode G3 is described as being supported at its large end portion 2 in an insulated manner through the windows 12 made in the large diameter cylindrical portion 1 of the second anode G4 it is to be realized, of course, that it could also be supported from its small diameter portion 5 by forming a window through the small diameter portion 6 of the second anode G4 and such arrangement is illustrated in FIG. 1*a*. Such arrangement also solves the problem of eccentricity in the principal lens and also the advantage is obtained that the outer diameter of the large diameter end portion 2 of the first anode G3 can be made to be very close to the inside diameter of the large diameter cylindrical portion 1 of the second anode and thereby the diameter of the principal lens can be made larger.

So as to ensure that the second anode G4 remains round, it is possible to fit another part on it and form the second anode G4 into a two part structure.

Also, the first anode G3 may be applied with an auxiliary support 14 at its small diameter portion such as shown in dotted line in FIG. 1 or by fitting a ring formed spacer thereon and then the insulating support of the first anode G3 becomes more secure.

Since as described the present invention is structured such that the large diameter end portion of the first anode 2 is mounted within the large diameter cylindrical portion 1 of the second anode, a large aperture principal lens can be formed and an electron gun having excellent beam focussing characteristics can be obtained. Particularly, since windows 11 are formed in the large diameter cylindrical portion 1 of the second anode and the large diameter end portion 2 of the first anode is arranged so that it is supported in an insulated manner through these windows the first and second anodes will be concentric which results in an improved principal lens. Also, since the support of the first anode is adjacent the right end of the first anode, the principal lens parts will not move relative to each other and a more secure and improved structure results.

Since the first anode is supported at its large diameter end portions, sufficiently high mechanical strength is achieved in the support member so that the first anode can be securely supported in an insulating manner and, thus, a highly reliable electron gun can be obtained. Since the first anode can be supported in an insulated manner, also at its small diameter portion through the windows, it is then possible to bring the outer diameter of the first anode very close to the inner diameter of the large diameter cylindrical portion of the second anode and a principal lens of larger aperture can therefore be provided. Thus, the electron gun of the present invention is suited for the application to high resolution color ray tubes and also to beam index color cathode ray tubes.

Although the invention has been described with respect to preferred embodiments, it is not to be so limited as changes and modifications can be made which are within the full intended scope of the invention as defined by the appended claims.

I claim as my invention:

1. An electron gun for cathode ray tubes comprising an arrangement of a cathode, a control electrode, an accelerating electrode, a first anode, and a second anode mounted in alignment, said second anode consisting of a small diameter supporting end portion and a large diameter cylindrical portion connected thereto;

said second anode formed with windows in said large diameter cylindrical portion at positions away from where a principal lens is formed;

said first anode being mounted within said small diameter supporting end portion and out of contact therewith and said first anode having a large diameter end portion which is mounted within said windows, and said large diameter end portion forming a component of the principal lens; and said first anode supported at a position of said large diameter end portion by insulating support members which extend through said windows in said second anode.

2. An electron gun according to claim 1 wherein said small diameter supporting end portion is also insulatingly supported at a second position remote from said second anode.

* * * * *